US010011329B1

(12) United States Patent
Cooper

(10) Patent No.: US 10,011,329 B1
(45) Date of Patent: Jul. 3, 2018

(54) CONVERTIBLE WATERCRAFT

(71) Applicant: Bote, LLC, Fort Walton Beach, FL (US)

(72) Inventor: Corey Cooper, Destin, FL (US)

(73) Assignee: Bote, LLC, Fort Walton Beach, FL (US)

( * ) Notice: Subject to any disclaimer, the term of this patent is extended or adjusted under 35 U.S.C. 154(b) by 0 days.

(21) Appl. No.: 15/614,183

(22) Filed: Jun. 5, 2017

(51) Int. Cl.

| | |
|---|---|
| ***B63B 35/71*** | (2006.01) |
| ***B63B 35/79*** | (2006.01) |
| ***B63H 20/02*** | (2006.01) |
| ***B63H 20/04*** | (2006.01) |
| *B63B 3/48* | (2006.01) |

(52) U.S. Cl.
CPC ..... *B63B 35/71* (2013.01); *B63H 20/02* (2013.01); *B63B 3/48* (2013.01); *B63B 35/7943* (2013.01); *B63B 2035/715* (2013.01); *B63H 20/04* (2013.01)

(58) Field of Classification Search
CPC ..... B63B 35/71; B63B 35/731; B63B 35/79; B63B 35/7943; B63B 35/7946; B63B 35/795; B63B 2035/715; B63B 3/48; B63B 2003/485; B63B 3/50; B63B 3/52; B63B 3/54; B63H 20/02; B63H 2020/025; B63H 20/04; B63H 20/06
USPC ..... 248/640–643
See application file for complete search history.

(56) References Cited

U.S. PATENT DOCUMENTS

| | | | | |
|---|---|---|---|---|
| 2,698,447 A * | 1/1955 | Potts | B63B 7/087 | 114/345 |
| 3,434,452 A * | 3/1969 | Crow | B63B 1/14 | 114/55.55 |
| 3,693,577 A * | 9/1972 | Sade | B63B 35/7943 | 114/55.56 |
| 3,989,002 A * | 11/1976 | Peterson | B63B 35/731 | 114/55.56 |
| 4,836,298 A * | 6/1989 | Laboureau | B63B 1/12 | 114/283 |
| 5,522,338 A * | 6/1996 | Eilert | B63B 7/082 | 114/197 |
| 6,085,678 A * | 7/2000 | Wurzburg | B63B 35/795 | 114/61.1 |
| 7,182,037 B2 * | 2/2007 | Otobe | B63B 7/087 | 114/343 |

FOREIGN PATENT DOCUMENTS

| | | | |
|---|---|---|---|
| EP | 0061878 A2 * | 10/1982 | B63B 7/02 |

OTHER PUBLICATIONS

Website screenshot of Shallow water skiff pictures Solo Skiff; www.soloskiff.com; Mar. 23, 2016.
Website screenshot of 2013 Ambush micro skiff 6hp Toatsu; www.microskiff.com; Dec. 11, 2014.
Website screenshot of Sea Eagle FishSUP 12'6"—Inflatable Fishing iSUP; https://www.youtube.com/watch?v=NP-J_VijrkQ; May 9, 2016.

* cited by examiner

*Primary Examiner* — Ajay Vasudeva
(74) *Attorney, Agent, or Firm* — Shane M. Delsman; Godfrey & Kahn, S.C.

(57) ABSTRACT
In at least some embodiments, the invention is directed to a watercraft that includes a selectively attachable motor mount.

26 Claims, 13 Drawing Sheets

CONVERTIBLE WATERCRAFT

FIELD OF THE INVENTION

The invention relates generally to the field of watercrafts, and more particularly to selectively adding and removing a motor mount to and from such watercrafts.

BACKGROUND

Various types of watercrafts are commonly used to traverse water. Some such watercrafts include recreational watercrafts, such as paddleboards, surfboards, canoes, kayaks, wake boards, sailboats, skiffs, etc.

Such recreational watercrafts are used by a growing population of people with a wide variety of abilities, e.g. professionals to occasional users, and for a wide variety of purposes, e.g. exercise, fishing, leisure, etc. As the disparity between skill levels of users and consumers of such recreational watercrafts grows, there is a growing need to make such recreational watercrafts desirable and usable by people of many different skill levels. Further, as the number of uses for such recreational watercrafts grows, there is a growing desire to make such recreational watercrafts usable and adaptable to many different uses.

Having a single or low number of different recreational watercraft models be adaptable to people with a variety of skill levels and variety of uses has a number of advantages. For example, such an adaptable recreational watercraft increases the potential target consumer pool and sales of such recreational watercraft. Having a single or low number of different recreational watercraft models decreases the manufacturing cost, e.g. decreasing the number of different parts or manufacturing processes for different watercrafts, the manufacturing learning curve, the number of different promotional materials, etc., and decreases the retail cost, e.g. less floor space, less warehouse space, etc.

As such, there is a need for a convertible or adaptable watercraft that can be used by people with a variety of skill/ability levels and for a variety of uses.

It will be understood by those skilled in the art that one or more aspects of the recreational watercraft and method of assembly can meet certain objectives, while one or more other aspects can lead to certain other objectives. Other objects, features, benefits and advantages of the recreational watercraft and method of assembly will be apparent in this summary and descriptions of the disclosed embodiments, and will be readily apparent to those skilled in the art. Such objects, features, benefits and advantages will be apparent from the above as taken in conjunction with the accompanying figures and all reasonable inferences to be drawn therefrom.

BRIEF DESCRIPTION OF THE DRAWINGS

The accompanying drawing figures, which are incorporated in and constitute a part of the description, illustrate several aspects of the recreational watercraft, and together with the description, serve to explain the principles of the recreational watercraft. The following description is based on embodiments of the recreational watercraft and should not be taken as limiting the recreational watercraft with regard to alternative embodiments that are not explicitly described herein. A brief description of the figures is as follows.

Figure 1:
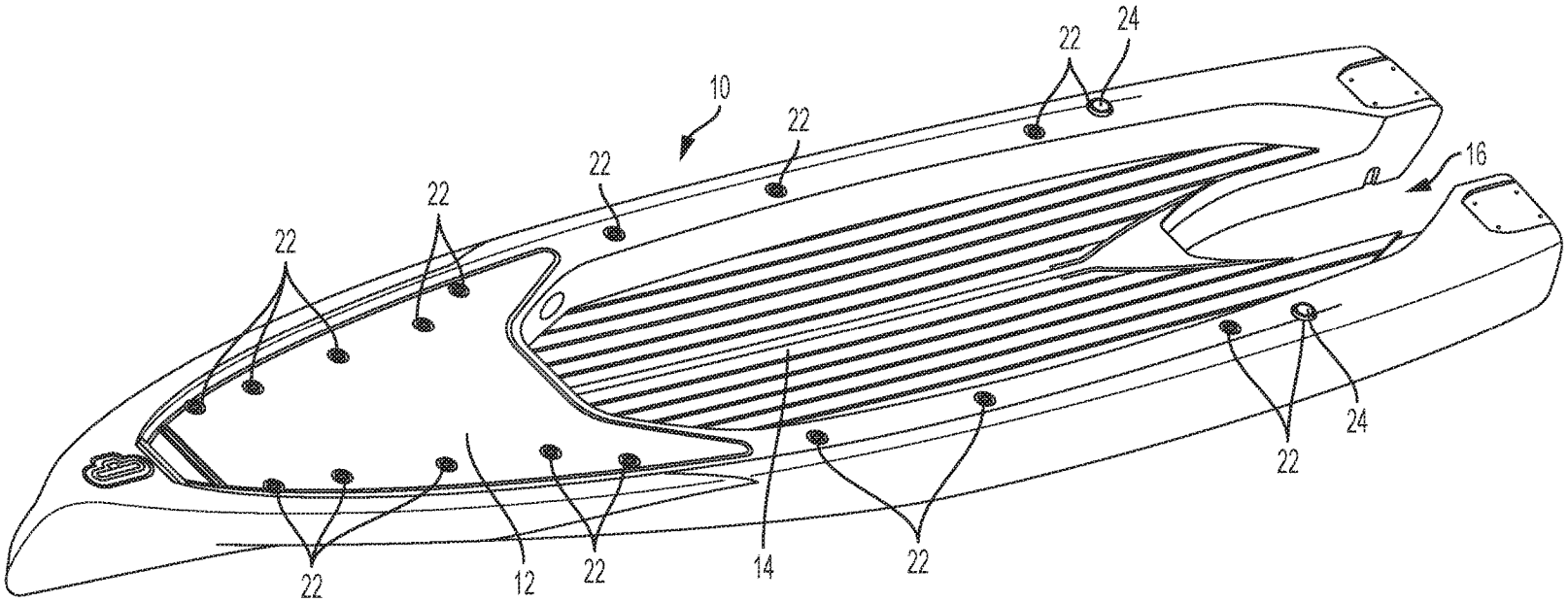
FIG. 1 is a top front perspective view of a recreational watercraft.

In view of the many possible embodiments to which the principles of the present invention may be applied, it should be recognized that the embodiments described herein with respect to the drawing figures are meant to be illustrative only and should not be taken as limiting the scope of the invention.

DETAILED DESCRIPTION

Referring to FIGS. 1-5, a recreational watercraft 10 is illustrated having a deck 12. The deck 12 may also include a track or deck pad 14. At the stern of the watercraft 10 is a slot 16 formed in and through the deck 12. The size and shape of the slot 16 allows for the motor to pivot up and down, e.g. use of motor to non-use of motor, as well as trim up and down by changing the propeller angle and thrust without coming into contact with the watercraft 10. The shape and size of the slot 16 helps with weight distribution, for example, by moving the weight of the motor closer to the center of the watercraft 10 and to reduce frictional drag, for example by reducing the amount of water displaced by the watercraft. Recreational watercraft are more susceptible to being affected by the weight of a motor because the weight of a motor is typically a greater percentage of the weight of a recreational watercraft than a boat.

Although the watercraft 10 is illustrated in FIGS. 1-5, as a paddleboard, any number of watercrafts could be used including, but not limited to skiffs, microskiffs, surfboards, canoes, kayaks, wake boards, sailboats, inflatable watercraft, etc. Further, although the deck pad 14 is seen as recessed below the surface of the deck 12, the deck pad could be on the surface of the deck or flush with the deck. However, having a recessed deck pad 14 provides for a center of gravity of the watercraft 10 that is closer to the bottom of the watercraft providing for easier balancing on the deck pad. The recessed deck pad 14 in combination with the slot 16 prevents water build up by allowing any water accumulated in the recessed deck pad to evacuate or exit via the slot.

Figure 3:
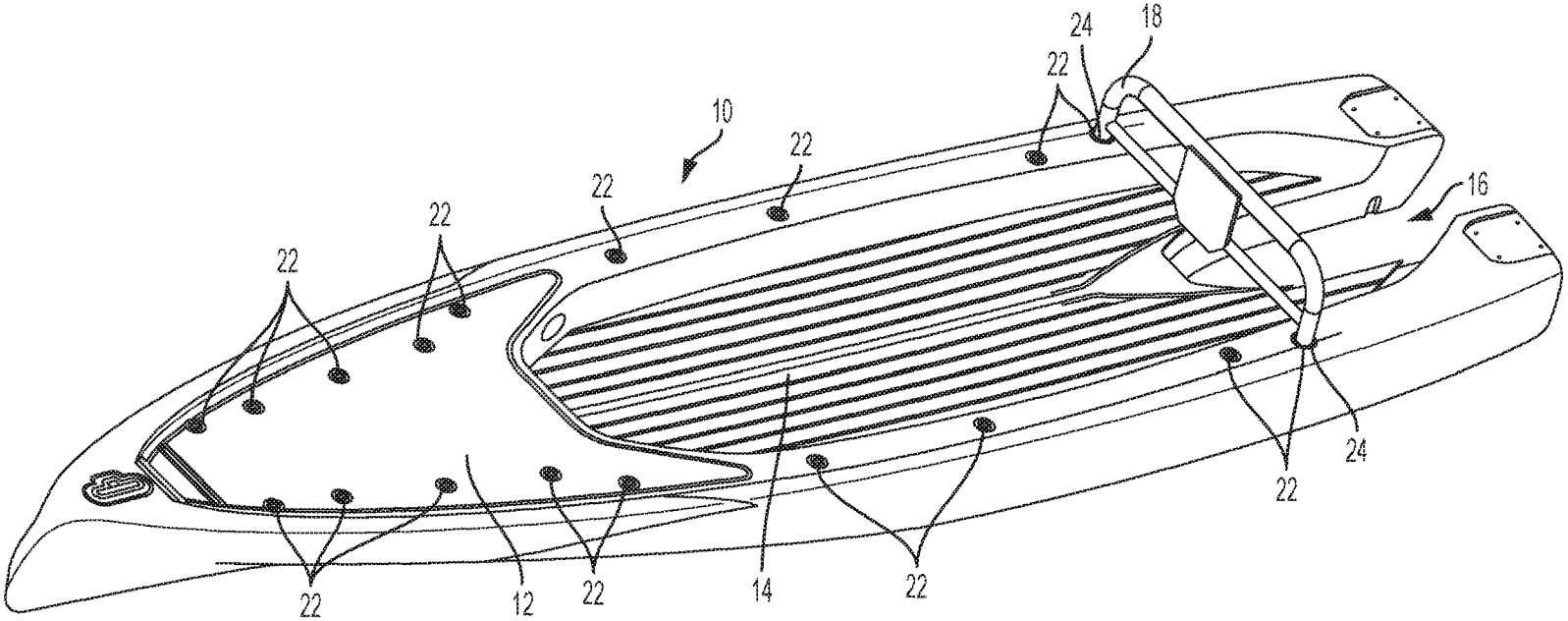
FIG. 3 is a top front perspective view of a recreational watercraft with a motor mount.
Figure 4:
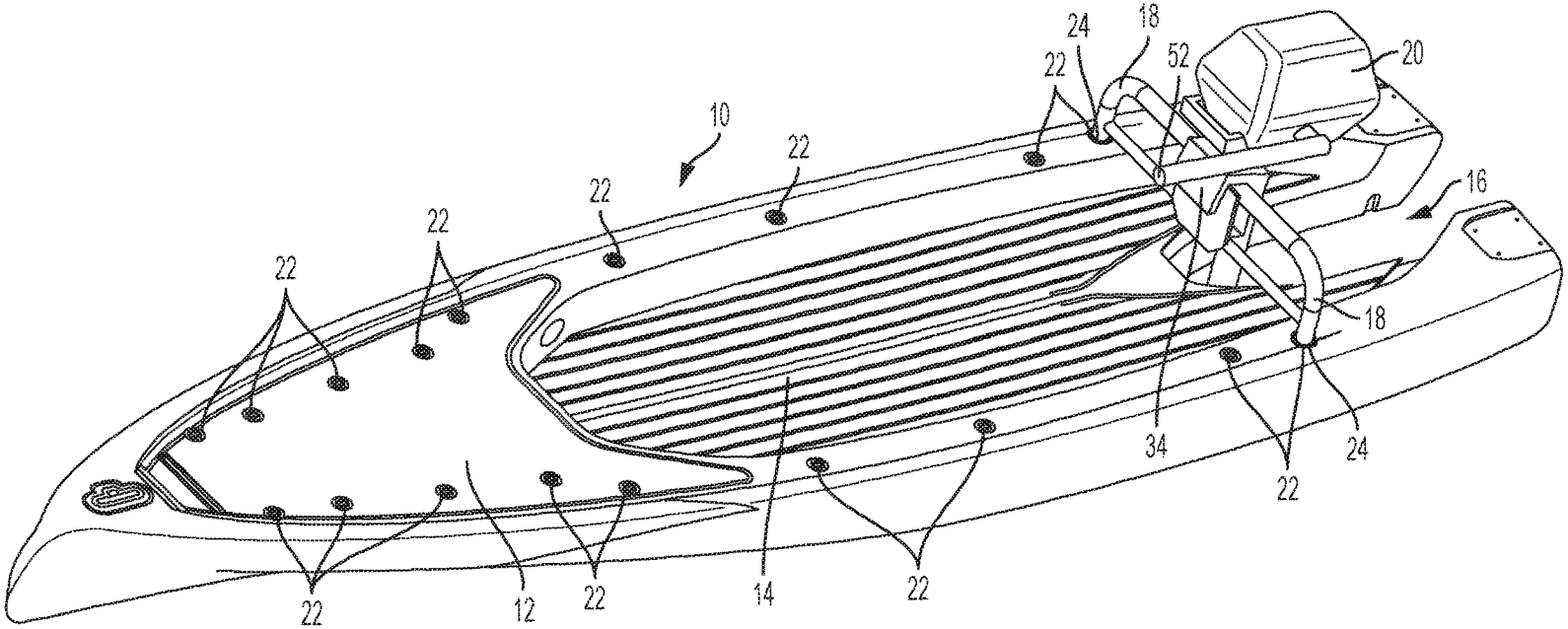
FIG. 4 is a top front perspective view of a recreational watercraft with a motor attached to a motor mount.
Figure 5:
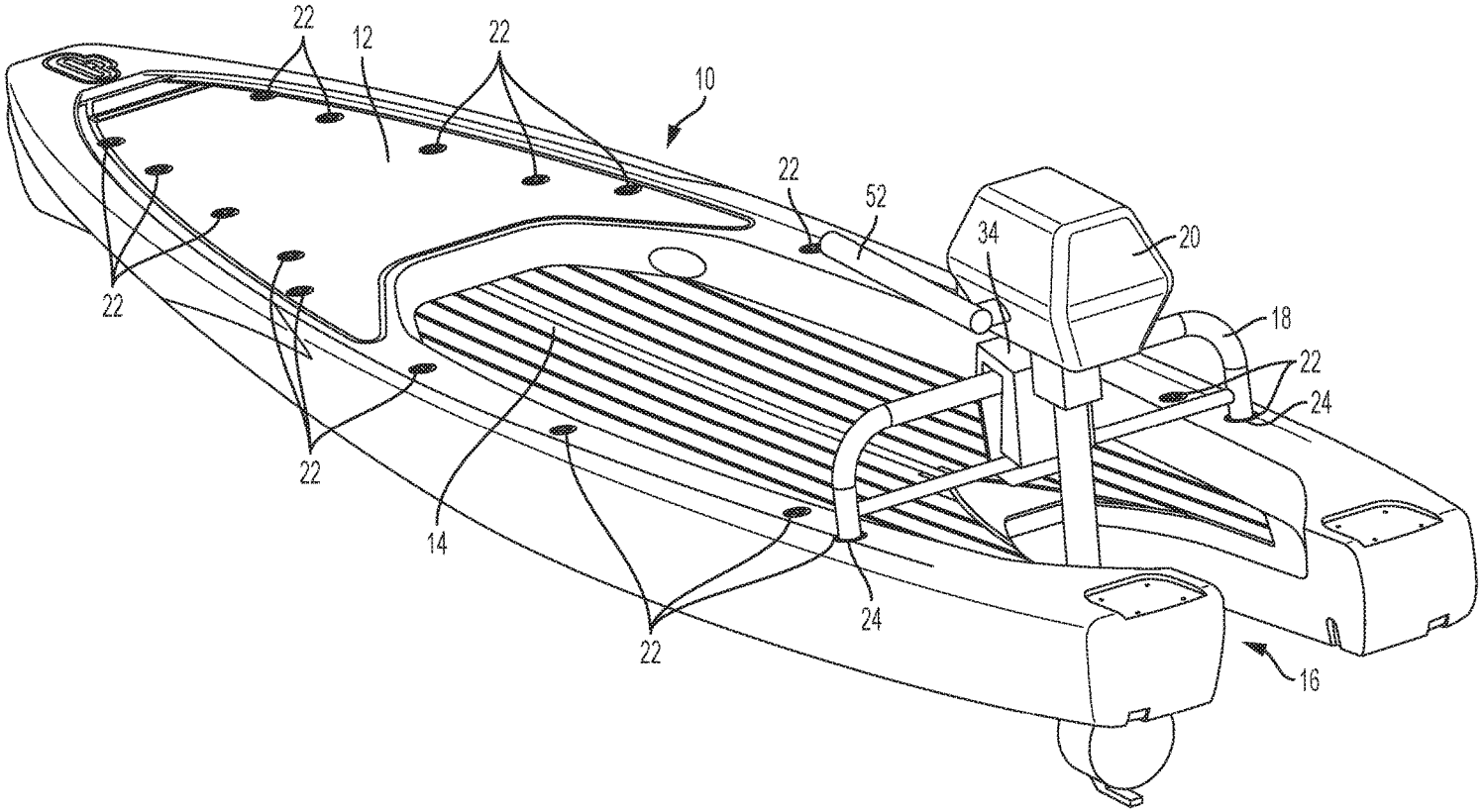
FIG. 5 is a top rear perspective view of a recreational watercraft with a motor attached to a motor mount.

The watercraft shown in FIGS. 3-5 provides a mount 18, e.g. a motor mount, for mounting a motor 20 to watercraft 10. As seen in FIG. 5, when mounted, the motor 20 extends down through the slot 16 and, when in the watercraft 10 is in the water, into the water, and the mount extends over a portion of the slot proximate the bow. The watercraft 10 can include a number of connectors 22 for attaching accessories to the watercraft. One common example of these connectors 22 are D-rings used to thread or lace a cord, such as a bungee cord, across a portion of the watercraft. At least one of the connectors 24 can be located for attaching a mount 18, such as a motor mount. In the embodiment seen in FIG. 4, the at least one of the connectors 24 for attaching a mount 18 are a pair of, or at least two, receptacles, blind bores or holes, one of each of the pair located on opposite sides, e.g. starboard and port, of the slot 16.

Figure 6:
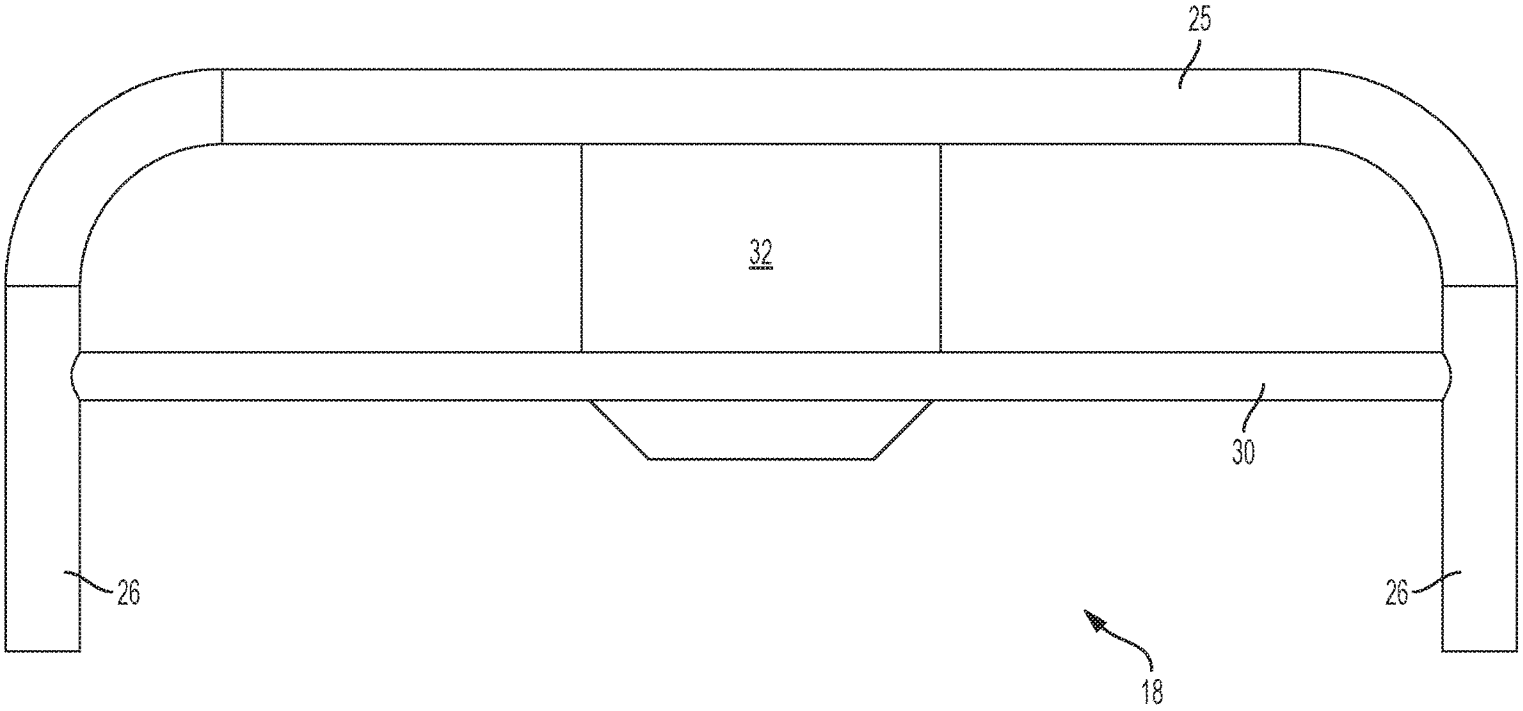
FIG. 6 is a front elevation view of a motor mount.
Figure 7:
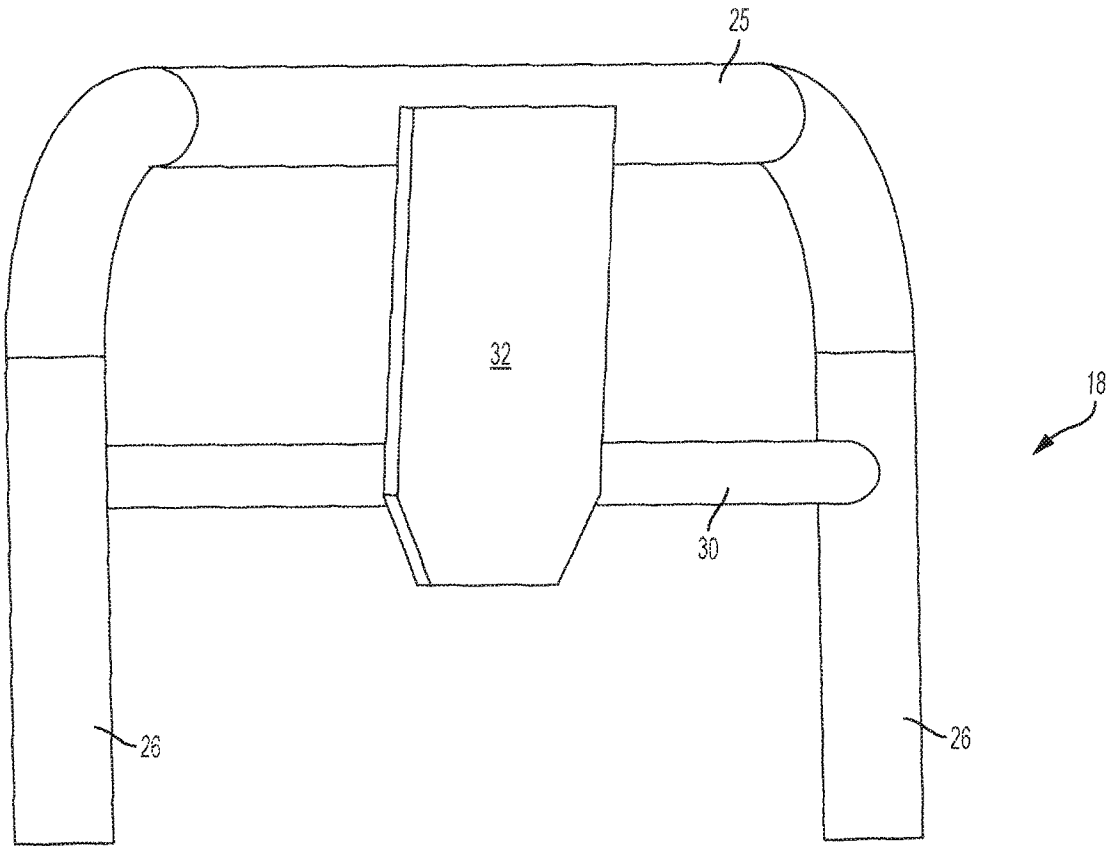
FIG. 7 is a front elevation view of the motor mount of FIG. 6.

The mount 18 can be generally made up of a framework of elements integrally formed or joined together. For example, one of the elements shown in the embodiment illustrated in FIGS. 6-7, is a "U" shaped portion 25. The receptacles 24 in the watercraft 10 are sized and shaped such that each of the two legs or posts 26 of the "U" shaped portion 25 may be selectively received in the respective receptacle 24. In the exemplary mount 18 seen in FIG. 6, the "U" shaped portion 25 of the mount is tubular and is formed by a bent metal pipe such as aluminum; however other materials could be used to support a motor and withstand the forces from a motor, e.g. other metals, wood, some plastics, composites such as acrylonitrile butadiene styrene and carbon fiber, without defeating the spirit of the invention. In the embodiment seen in FIGS. 3-5, the mount 18 extends generally from the starboard side to the port side of the watercraft 10.

As seen in FIG. 6, the exemplar mount 18 also includes a brace or crossbar 30 frame element that extends between the two legs 26. The crossbar 30 helps to provide strength to the mount 18, including by preventing twisting or racking of the mount. The crossbar 30 can also allow the attachment of additional accessories to the mount 18 as will be discussed further below. A plate or bearing 32 is attached or connected generally to the center of and between the "U" shaped portion 25 of the mount 18 and the crossbar 30. The plate 32 also provides strength to the mount 18, including by preventing twisting or racking of the mount, and is sized and shaped so as to be received by a motor bracket 34 of the motor 20. In other words, the plate 32 is configured such that a motor 20 can be attached to the mount 18 by the plate. The plate 32 is positioned within the mount 18 so that when a motor 20 is attached to the plate, a portion of the motor will extend through the slot. The motor 20 can be more securely attached to the mount 18 such as by using the motor clamps or screws of the motor.

Although the framework of elements forming the mount 18 shown in FIGS. 6-7 are illustrated as being welded together, other means for connecting such element could be used, riveting, bolting, gluing, etc., without defeating the spirit of the invention.

Figure 8:
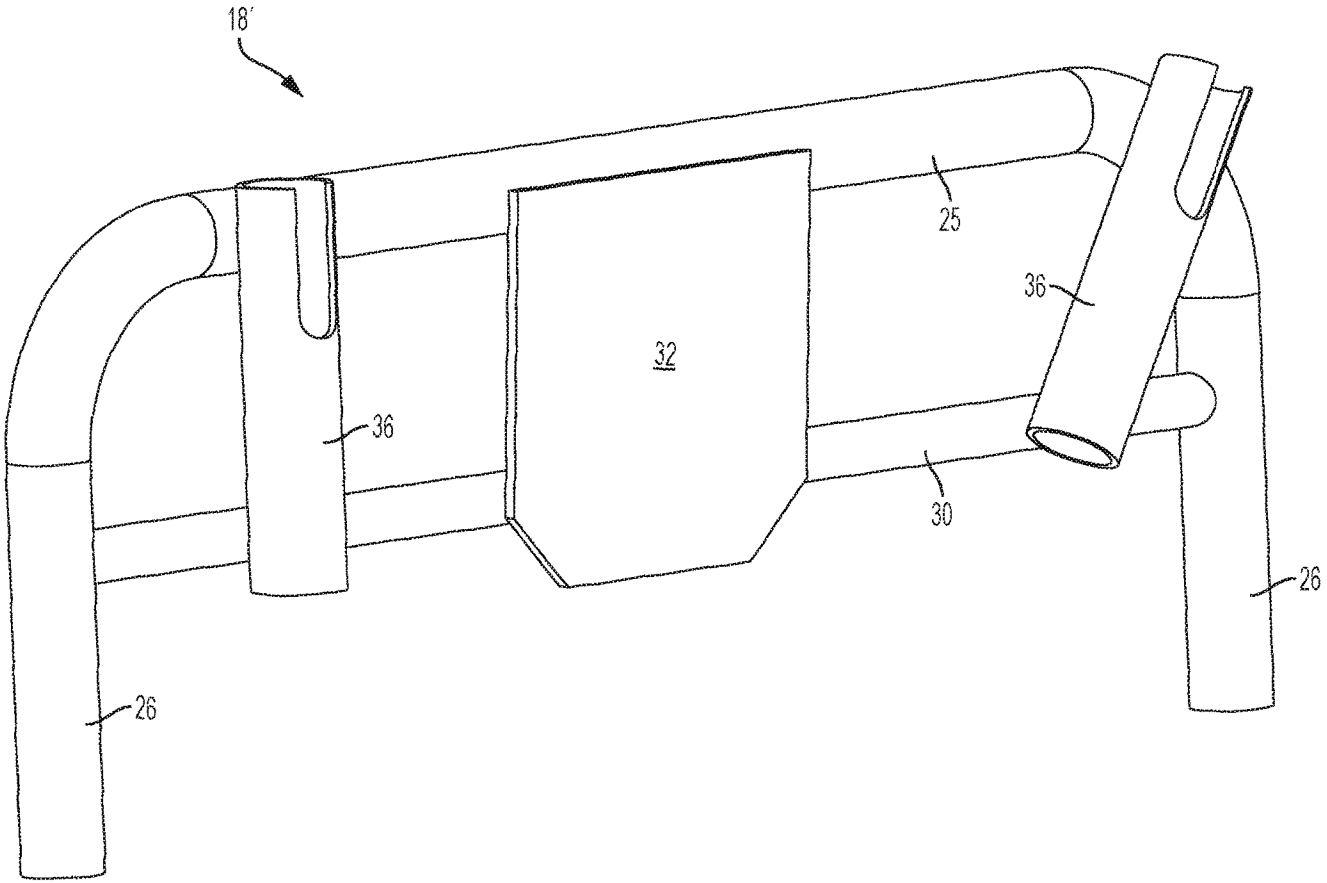
FIG. 8 is a front perspective view of an alternative embodiment of a motor mount with rod holders.
Figure 9:
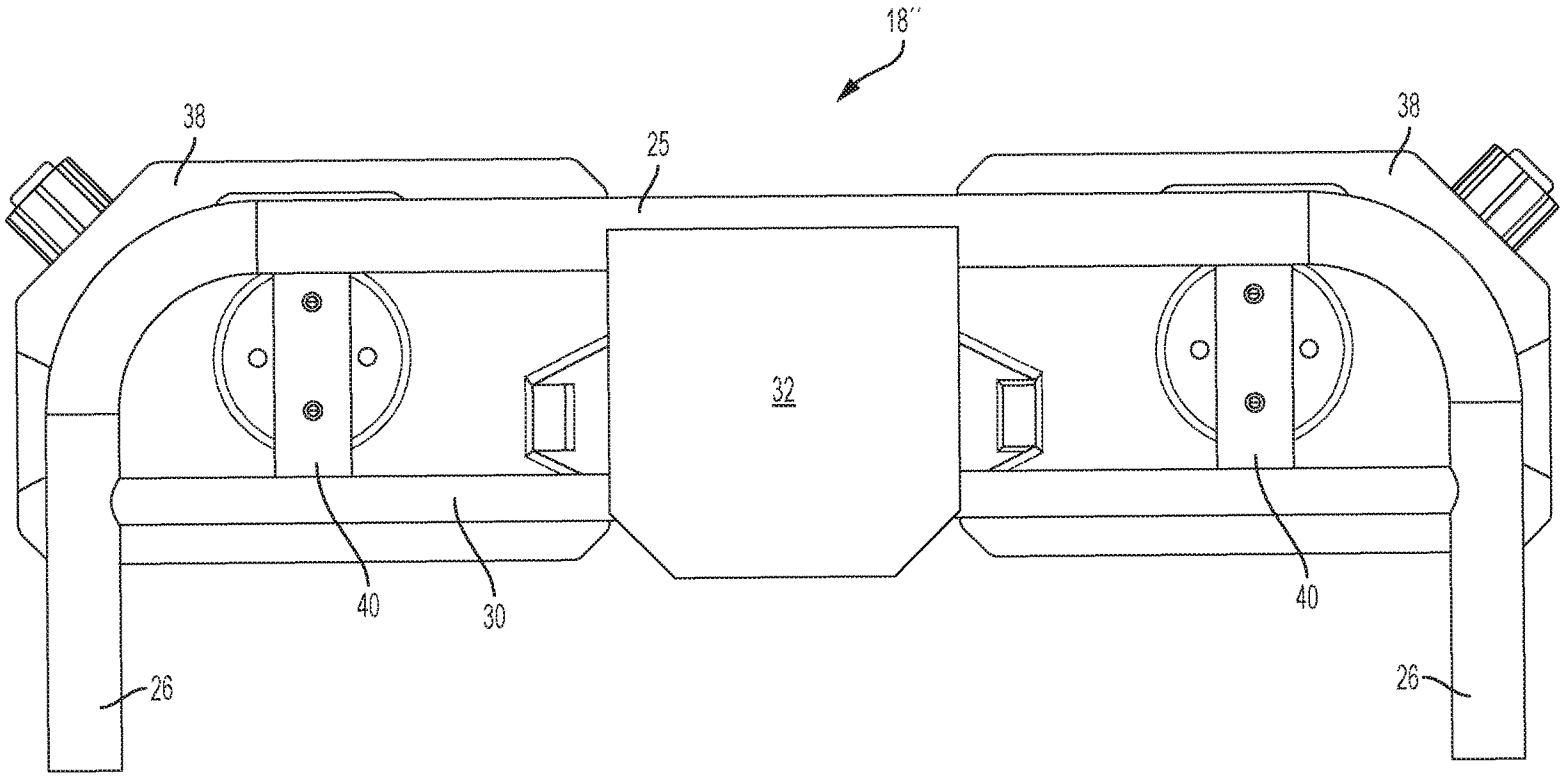
FIG. 9 is a front elevation view of an alternative embodiment of a motor mount with fuel tanks.

Accessories may also be included in the mount. One example of such accessories is a rod holder 36. In the embodiment of the mount 18' seen in FIG. 8, a pair of rod holders 36 are shown welded to the "U" shaped portion 25 and the crossbar 30; however, the rod holders could be attached by any number of means known in the art, e.g. clamped, bolted, etc., and could be permanently attached or selectively attached, without defeating the spirit of the invention. The location of the rod holders 36 in the embodiment shown in FIG. 8 does not interfere with the functionality or operation of the motor 20, e.g. they do not obstruct the steering handle 52 of the motor.

Figure 10:
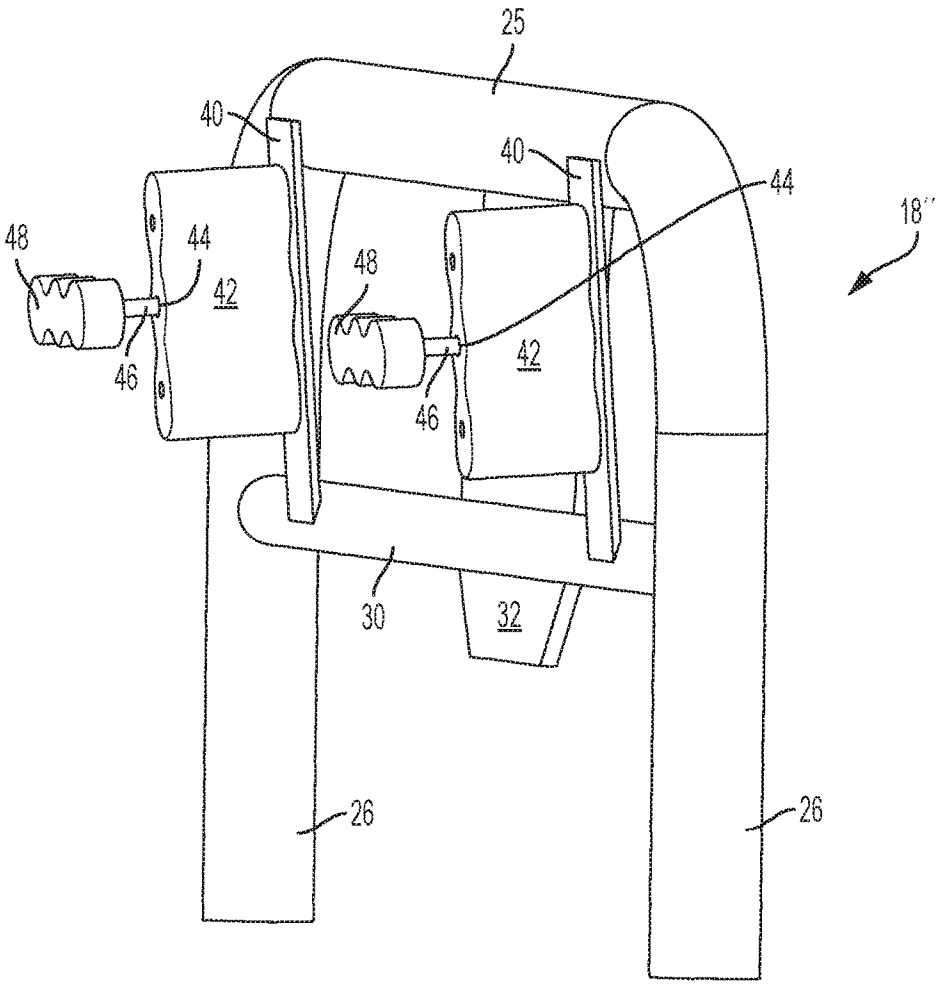
FIG. 10 is a side perspective view of the alternative embodiment of FIG. 9 with the fuel tanks removed.
Figure 11:
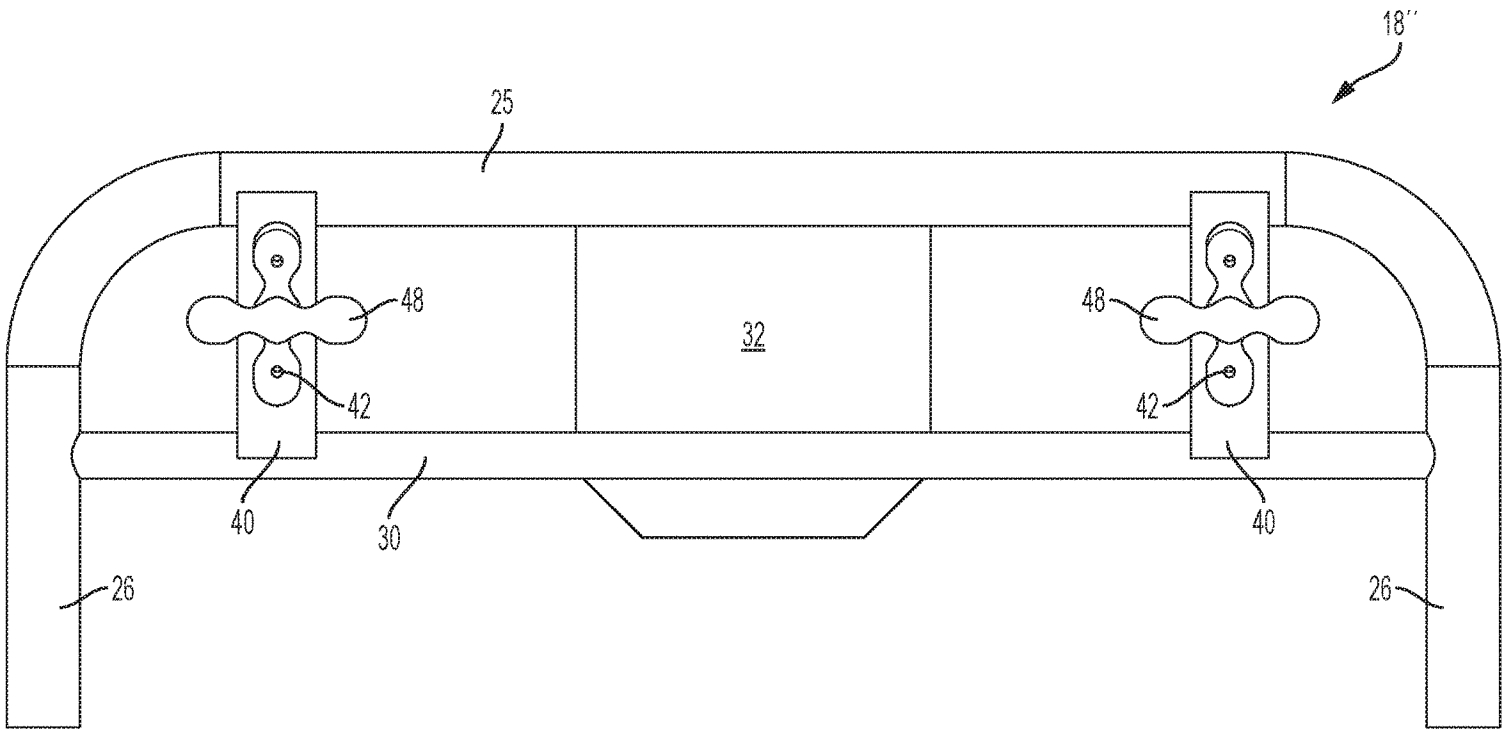
FIG. 11 is a rear elevation view of the alternative embodiment of FIG. 9.

The mount 18" seen in FIGS. 9-12 includes an attachment means for attaching fuel tanks 38. The embodiment of the mount 18" seen in FIG. 9 includes a support bar 40 on each side of the mount. The support bars 40 extend between the "U" shaped portion 25 and the crossbar 30. In the embodiment seen in FIG. 10, a locator 42 is attached to the support bar 40. A threaded hole 44 is provided in the locator 42 and/or the support bar 40 that is sized to receive a threaded post 46 with a handle 48 as seen in FIG. 10.

Figure 12:
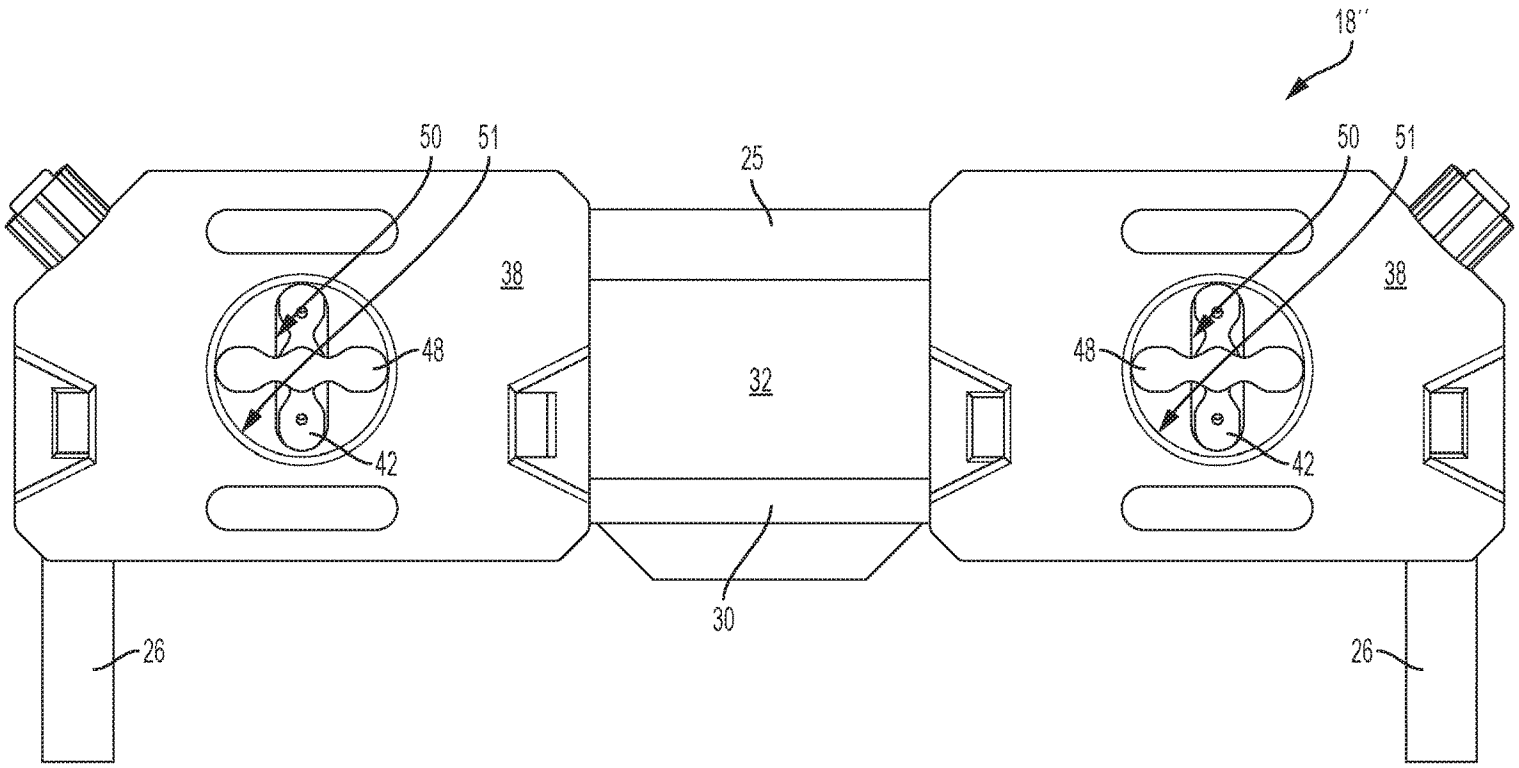
FIG. 12 is a rear elevation view of the alternative embodiment of FIG. 9.

As seen in FIG. 12, the fuel tank 38 has a rectangular hole 50 formed there-through. The rectangular hole 50 is sized large enough to receive the locator 42. When the locator 42 is in the rectangular hole 50, the locator supports the fuel tank 38. The fuel tank also has a circular aperture 51 formed in it that extends partially through the fuel tank. The circular aperture 51 is sized larger than the handle 48 such that the handle can fit within the aperture 51. The smaller the tolerance between the rectangular hole 50 and the locator 42 and between the circular aperture 51 and the handle 48, the less the fuel tanks 38 will be able to move when secured, e.g. rattling due to waves.

Once the fuel tank 38 is seated on the locator 42, the threaded post 46 with handle 48 can be threaded into the threaded hole 44. As the threaded post 46 is screwed into the threaded hole 44, the handle 48 will come into contact with the fuel tank 38 and hold the fuel tank to the support bar 40 and, thereby, the mount 18". One advantage of the circular aperture 51 is that the handle 48 is recessed within the aperture when the fuel tank 38 is secured to the mount 18" and thus out of the way. Further, in the embodiment shown in FIGS. 9-12, the fuel tanks 38 do not interfere with the functionality or operation of the motor 20, e.g. they do not obstruct the steering handle 52 of the motor.

When it is desired to have a motorized watercraft 10, e.g. a microskiff, the legs 26 of the mount can be slid into the receptacles 24. With the receptacles 24 being sized slightly larger than the legs 26, the mount 18 will be held with friction with little to no play. The motor mounting bracket 34 of the motor 20 can be slipped onto the plate 32 and the motor clamps and/or screws tightened down to further secure the motor 20 to the mount 18. In this position, the motor 20 is supported by the mount 18. The weight of the motor 20 will further help to hold the mount 18 in the receptacles 24. Once attached to the mount 18, the motor 20 can also be tilted using the motor's trim locks. The watercraft 10 is then ready to be used as a motorized watercraft.

To use the watercraft 10 as a non-motorized watercraft, e.g. a paddleboard, the motor 20 can be disconnected from the plate 32 of the mount 18 and the mount lifted out of the receptacles 24.

The mount 18 can also support a large variety of motors 20, e.g. gas, electric, trolling, etc. As previously discuss, the size and shape of the slot 16 can allow the motor 20 to be selectively used and not used while still attached to the mount 18 and to be used at a number of different angles and thrusts. Different mounts 18 can be used to accommodate different motors, e.g. long shaft and short shaft motors.

Figure 13:
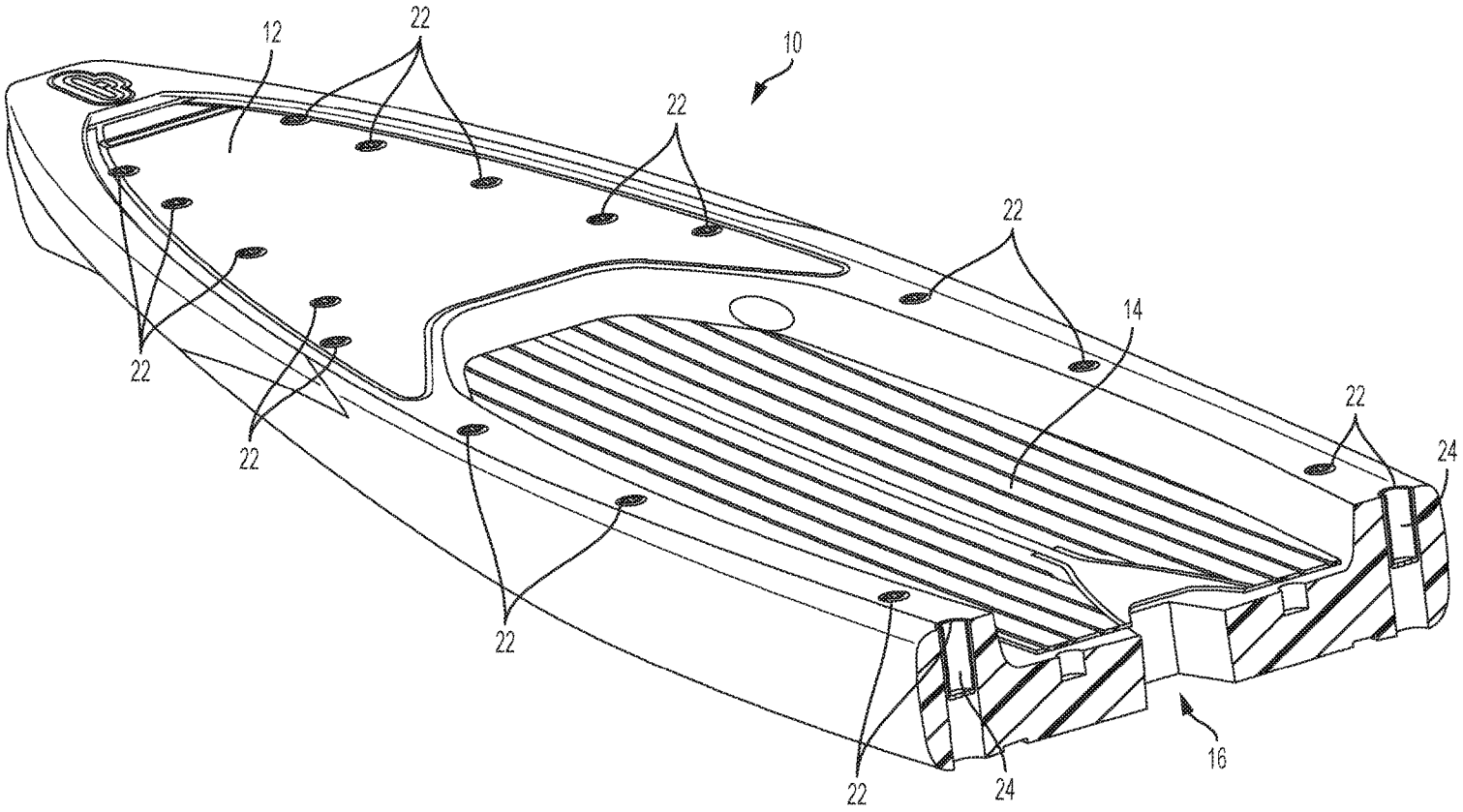
FIG. 13 is a rear cross-sectional perspective view of the watercraft of FIG. 2 taken along the line 13-13.

The receptacles 24 are set deep enough in the watercraft 10 to sufficiently hold the mount 18 and motor 20 and resist torque and other forces from the motor. The receptacles 24 could simply be holes or openings through the deck 12 of the watercraft 10. However, the receptacles 24 can also be reinforced. For example, the receptacles 24 could be integrally formed in the watercraft 10 using the material forming the deck 12 or shell of the watercraft. The receptacles 24 could also be made from a different material such as wood, fiberglass, plastics, polycarbonate or metal and bonded in the watercraft 10 such as by epoxy, glue, fasteners, friction, snap-fit, etc. Using a polycarbonate material provides a strong, yet light weight receptacle 24. As seen in the embodiment shown in FIG. 13, the receptacles 24 are a cup like shaped member, e.g. a cylinder with one end open, and bonded into the watercraft 10. The use of a material to partially enclose the receptacles 24 helps to prevent damage to and water from entering the watercraft 10.

Figure 2:
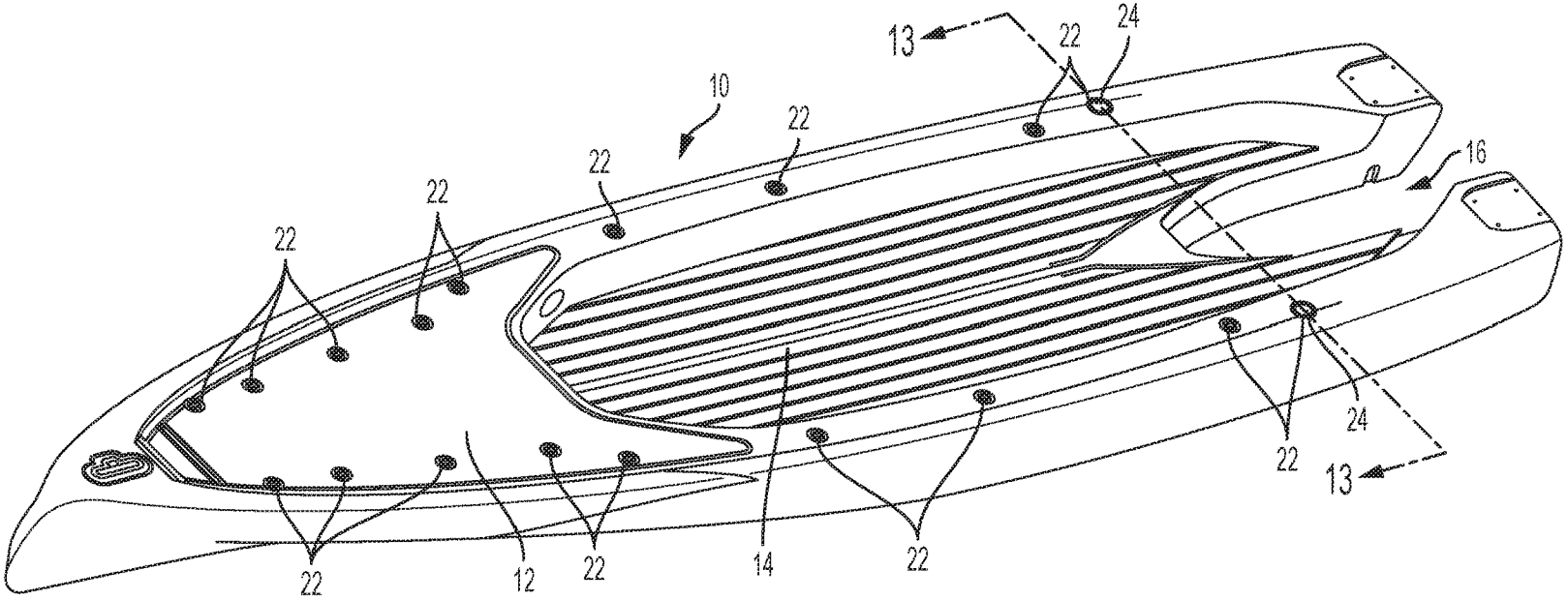
FIG. 2 is a top front perspective view of an alternative embodiment of a recreational watercraft.

The receptacles 24 could rise slightly above the deck 12 as seen in FIG. 2 or be mounted flush with the surface of the deck as seen in FIG. 1. Setting the receptacles 24 flush with the deck prevents the receptacles from being an obstacle on the watercraft 10 when the mount 18 is not installed e.g. tripping, loss of board space for accessories, safety hazard, etc. Setting the receptacles 24 slightly above the deck 12 helps to prevent the legs 26 of the mount 18 from damaging the deck, e.g. from scraping the deck as one tries to insert the legs into the receptacles.

Although the embodiments shown in FIGS. 1-13 include two legs 26 and two receptacles 24, more or less legs and receptacles could be used without defeating the spirit of the invention. For example, if additional support is desired for a particular application or motor, additional legs 26 could be added to the mount 18 that extend forward or rearward into additional respective receptacles or rest on the deck. More receptacles 24 could also be included to, for example, provide adjustment to the location of the motor 20 in the slot 16 due to, for example, size of the motor.

At least one company, Sea Eagle Boats, Inc., has offered a selectively attached motor mount to an inflatable stand-up paddleboard called the FishSUP. The board of the FishSUP has a small concave shaped stern. On the board is a pair of lugs, one on each side of the stern concavity, which is at least semi-permanently attached, e.g. by screws into the board. A plate is placed across the concavity and in a slot in each lug. Then a bolt is threaded into the first part of each lug, through the plate and into the second part of each lug to hold the plate to the board.

The FishSUP suffers from a number of disadvantages. First, the plate requires assembly, which may be difficult when the board is in the water, e.g. waves, weight distribution, etc. Second, parts of the FishSUP may be lost. For example, a screw could accidentally be misplaced or dropped into the water. Third, when the motor is not being used, the lugs are attached to the board and provide a surface obstacle, e.g. tripping, loss of board space for accessories, safety hazard, etc. Fourth, the small concavity and small plate permit only a small variety of motors to be used with the FishSUP. Fifth, the small concavity shifts the center of gravity when a motor is attached towards the stern of the board making balancing and use of the board more difficult. Sixth, the FishSUP mount is not aesthetically pleasing. Seventh, although not necessary, the FishSUP has no other accessories, such as a rod holder or gas can mount as compared to some embodiments of the mounts 18', 18".

Another company, Pelican International Inc., has offered a microskiff with a motor mount called the Ambush. The Ambush has a rectangular metal panel to which the motor can be mounted or dismounted. From each side of the metal panel is an arcuate metal pipe that extends down to the deck of the microskiff to support the metal panel. Another short straight metal pipe extends downward from the midsection of the arcuate metal pipes to the deck of the microskiff to further support the mount. Each of the two arcuate metal pipes and the two short straight metal pipes ends in a circular flange with four holes therein. Screws are used to attach the mount to the microskiff by inserting the screws through the holes in the circular flange and into the deck of the microskiff. Off the side of each short straight metal pipe is a rod holder.

The Ambush suffers from a number of disadvantages. First, the mount is semi-permanently attached to the microskiff. If it is desired to remove the mount, the screws must be removed, which may be difficult when the microskiff is in the water, e.g. waves, weight distribution, etc. and requires additional tools, e.g. a screwdriver. Second, parts of the Ambush may be lost. For example, a screw could accidentally be misplaced or dropped into the water. Third, the screws actually penetrate the deck of the microskiff. This results in damage to the deck, provides opportunities for water to penetrate the interior of the microskiff and decreases the aesthetics of the microskiff when the mount is not attached. Fourth, the deck alone may not be enough to resist the forces from the motor through repeated use, e.g. vibrations, torqueing, rocking, etc. Fifth, the mount places the motor behind the stern of the microskiff, thereby shifting the center of gravity when a motor is attached towards the stern of the microskiff making balancing and use of the microskiff more difficult. Sixth the location of the rod holders may prevent full mobility of the motor by it or a rod in the rod holder obstructing the steering handle of the motor.

Another product, called the Solo Skiff, is a motorized kayak. The Solo Skiff has a cut out for a motor. At the end of the cut out closest to the bow is a motor mount that is integrally formed with the polyethylene shell of the kayak. The mount is has a pyramidal base that rises from the deck with a thin rectangular portion rising therefrom for receipt by the motor bracket. Support members extend towards the stern from the pyramidal base on each side of the cut out.

The Solo Skiff suffers from a number of disadvantages. First, the mount is integrally formed with the shell of the kayak. Therefore, the mount cannot be removed and the kayak cannot perform as a traditional non-motorized kayak. Second, the mount, when not in use, will create a surface obstacle. This can result in a tripping or other safety hazard and the loss of space for accessories, cargo, equipment, etc. Third, the mount cannot be replaced or adjusted to best position the motor being used. For example, the owner's manual for the Solo Skiff provides "[l]ong shaft engines will not work."

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, it is to be understood that in at least some embodiments, plurality can include one or more of an element.

What is claimed is:

1. A watercraft comprising:

a deck with a top surface, a bottom surface and at least two receptacles with top and bottom ends, wherein the bottom end of each of the receptacles is closed at a location intermediate the top surface and the bottom surface of the deck;

a slot formed in the deck;

a mount having at least two legs and a plate;

wherein one of the at least two receptacles is located on each side of the slot;

wherein the plate is configured such that a propulsion motor can be attached to the mount by the plate;

wherein each of the at least two receptacles is configured to selectively and removably receive one of the at least two legs to support the mount and the propulsion motor; and wherein the plate is positioned within the mount such that when the propulsion motor is attached to the plate for propelling the watercraft a portion of the propulsion motor will extend through the slot.

2. The watercraft of claim 1, wherein the mount generally has a U shape.

3. The watercraft of claim 2, further comprising a crossbar that extends between the at least two legs.

4. The watercraft of claim 3, wherein the plate is connected to the U shaped mount and the crossbar.

5. The watercraft of claim 1, wherein the at least two receptacles are at least two holes integrally formed in the deck.

6. The watercraft of claim 5, wherein the at least two receptacles in the deck are reinforced.

7. The motor mount of claim 1, wherein the mount is sized to extend from a starboard side of the watercraft to a port side of the watercraft.

8. The watercraft of claim 1, wherein the at least two receptacles are cup like shaped members secured in the deck.

9. The watercraft of claim 8, wherein a top of each of the at least two receptacles are flush with a surface of the deck.

10. The watercraft of claim 1, wherein the at least two receptacles are located such that when the at least two legs are received in the at least two receptacles the mount extends over a portion of the slot proximate a bow of the watercraft.

11. The watercraft of claim 1, further comprising a deck pad;

wherein the deck pad is recessed below a surface of the deck; and wherein water on the deck pad can exit through the slot.

12. The watercraft of claim 1, wherein the at least two legs can be inserted into the at least two receptacles while the watercraft is in the water.

13. A watercraft comprising:

a deck with a top surface, a bottom surface and at least two receptacles, wherein a bottom end of each of the receptacles is closed at a location spaced away from the top surface and the bottom surface of the deck;

a slot formed in the deck;

a mount having at least two legs and a plate;

wherein one of the at least two receptacles is located on each side of the slot;

wherein the plate is configured such that a propulsion motor can be attached to the mount by the plate;

wherein each of the at least two receptacles is configured to selectively and removably receive one of the at least two legs to support the mount and the propulsion motor;

wherein the at least two legs can be inserted into the at least two receptacles while the watercraft is in the water; and wherein the plate is positioned within the mount such that when the propulsion motor is attached to the plate for propelling the watercraft a portion of the propulsion motor will extend through the slot.

14. The watercraft of claim 13, wherein the at least two legs can be removed from the at least two receptacles without deforming the watercraft.

15. The watercraft of claim 13, wherein the mount generally has a U shape.

16. The watercraft of claim 15, further comprising a crossbar that extends between the at least two legs.

17. The watercraft of claim 15, wherein the plate is connected to the U shaped mount and the crossbar.

18. The watercraft of claim 13, further comprising a deck pad;

wherein the deck pad is recessed below a surface of the deck; and wherein water on the deck pad can exit through the slot.

19. A watercraft comprising:

a deck with at least two receptacles;

a slot formed in the deck;

a mount having at least two legs and a plate, wherein the mount is an inverted U-shaped tubular structure;

wherein one of the at least two receptacles is located on each side of the slot;

wherein the plate is configured such that a propulsion motor can be attached to the mount by the plate;

wherein each of the at least two receptacles is configured to selectively and removably receive one of the at least two legs to support the mount and the propulsion motor; and wherein the plate is positioned within the mount such that when the propulsion motor is attached to the plate for propelling the watercraft a portion of the propulsion motor will extend through the slot.

20. The watercraft of claim 19, wherein a bottom of each of the least two legs does not extend through the bottom surface of the deck.

21. The watercraft of claim 19, wherein each of the at least two receptacles are blind bores.

22. The watercraft of claim 19, wherein the at least two receptacles are at least two holes integrally formed in the deck.

23. The watercraft of claim 22, wherein the at least two receptacles in the deck are reinforced.

24. The motor mount of claim 19, wherein the mount is sized to extend from a starboard side of the watercraft to a port side of the watercraft.

25. The watercraft of claim 19, wherein the at least two receptacles are cup like shaped members secured in the deck.

26. The watercraft of claim 19, wherein the at least two receptacles are located such that when the at least two legs are received in the at least two receptacles the mount extends over a portion of the slot proximate a bow of the watercraft.

* * * * *